US009885206B2

(12) United States Patent
Shin

(10) Patent No.: US 9,885,206 B2
(45) Date of Patent: Feb. 6, 2018

(54) SLIDING DOOR SELF-CLOSING DEVICE

(71) Applicant: Jung-Chul Shin, Incheon (KR)

(72) Inventor: Jung-Chul Shin, Incheon (KR)

( * ) Notice: Subject to any disclaimer, the term of this patent is extended or adjusted under 35 U.S.C. 154(b) by 0 days.

(21) Appl. No.: 15/403,334

(22) Filed: Jan. 11, 2017

(65) Prior Publication Data

US 2017/0198510 A1 Jul. 13, 2017

(30) Foreign Application Priority Data

May 2, 2016 (KR) ..... 10-2016-0053994

(51) Int. Cl.

| | |
|---|---|
| ***E05F 3/00*** | (2006.01) |
| ***E05F 5/00*** | (2017.01) |
| ***E06B 3/46*** | (2006.01) |
| ***E05D 15/06*** | (2006.01) |
| ***E05F 1/16*** | (2006.01) |

(52) U.S. Cl.

CPC ..... *E05F 5/003* (2013.01); *E05D 15/063* (2013.01); *E05F 1/16* (2013.01); *E05F 3/00* (2013.01); *E06B 3/4636* (2013.01); *E05Y 2800/24* (2013.01); *E05Y 2900/132* (2013.01); *Y10T 16/364* (2015.01)

(58) Field of Classification Search

CPC ..... E05Y 2900/132; E05Y 2201/684; E05Y 2201/614; E05Y 2201/64; E05Y 2201/688; E05D 15/063; E05D 15/0652; E05D 15/0665; E05D 15/0686; E05D 15/0691; E05D 15/0669; E05D 15/0621; Y10T 29/49778; Y10T 16/376; Y10T 16/359

USPC ..... 49/425

See application file for complete search history.

(56) References Cited

U.S. PATENT DOCUMENTS

| | | | | |
|---|---|---|---|---|
| 8,117,784 | B2 * | 2/2012 | Tarrega Illoret | E05D 15/063 16/106 |
| 8,127,494 | B2 * | 3/2012 | Kondash | E05F 15/684 49/197 |
| 8,402,606 | B1 * | 3/2013 | Tsai | E05F 3/18 16/49 |
| 8,443,551 | B2 * | 5/2013 | Walhorn | E05F 1/16 16/71 |
| 9,388,622 | B1 * | 7/2016 | Paron | E05F 15/56 |
| 2011/0247275 | A1 * | 10/2011 | Coleman | E05F 15/605 49/358 |

(Continued)

FOREIGN PATENT DOCUMENTS

| | | | |
|---|---|---|---|
| KR | 10-1119924 | 2/2012 | E05C 17/06 |
| KR | 20-0474484 | 9/2014 | E05D 15/06 |
| KR | 10-1548488 | 8/2015 | E05F 1/08 |

*Primary Examiner* — Justin B Rephann

(74) *Attorney, Agent, or Firm* — Harness, Dickey & Pierce, P.L.C.

(57) ABSTRACT

Disclosed is a sliding door self-closing device configured to automatically close a door moving along a rail straightly aligned with an extension rail. The sliding door self-closing device includes a damper configured to move along the rail to automatically close the door and smoothen a closing speed, and a roller assembly pivotably connected to a front end of the damper to move along the rail and provided to be rotatable at the front end of the damper by a predetermined angle. Therefore, it is possible to ensure appropriate driving along the rail even when the rail is deformed. In addition, it is possible to easily remove the damper and the roller assembly through a short space of the extension rail.

4 Claims, 10 Drawing Sheets

(56) References Cited

U.S. PATENT DOCUMENTS

| | | | | |
|---|---|---|---|---|
| 2013/0160240 | A1* | 6/2013 | Kenny | E05D 15/0626 16/89 |
| 2014/0090301 | A1* | 4/2014 | Takahashi | E05D 15/063 49/360 |
| 2014/0310913 | A1* | 10/2014 | Horwood | E05D 15/0669 16/100 |
| 2016/0138313 | A1* | 5/2016 | Kreyenborg | E05D 15/0634 49/409 |
| 2016/0138314 | A1* | 5/2016 | Kreyenborg | E05D 15/0643 49/420 |

* cited by examiner

SLIDING DOOR SELF-CLOSING DEVICE

CROSS REFERENCE TO RELATED APPLICATIONS

The present application claims benefit of and priority to Korean Patent Application No. 2016-0053994, filed in the Korean Patent Office on May 2, 2016, the entire contents of which are incorporated herein by reference.

FIELD

The present disclosure relates to a sliding door self-closing device, and more particularly, to a sliding door self-closing device capable of allowing a sliding door to be appropriately driven even on a deformed rail and facilitating removal of the sliding door from the deformed rail.

BACKGROUND

In general, doors are classified into a hinged type and a sliding type depending on its open/close mechanism. In the case of the hinged type, a hinge structure is installed between a wall and a door to allow the door to be opened or closed as the door is pushed or pulled. In the case of the sliding type, a rail is installed above or below the door, and the door is opened or closed by sliding along the rail.

In the sliding type, an integrated module of a roller assembly and a damper also slides along the rail provided above the door. In this case, if a significantly long rail is deformed, or the rail is irregularly deformed by an external force, it is difficult to appropriately drive the roller assembly and the damper designed to internally slide along the rail due to the deformed rail.

An extension rail is provided in straight alignment with the rail in order to allow a user to perform maintenance or inspection by removing the roller assembly and the damper from the rail. However, if the rail is deformed as described above, it is difficult to separate the extension rail and then remove the roller assembly and the damper from the rail through the removed space.

PATENT LITERATURES

[Patent Literature 1] Korean Utility Model Application No. 20-2013-0001671 (Registration No. 20-0474484)

SUMMARY

In view of the aforementioned problems, the present disclosure provides a sliding door self-closing device by which the damper and the roller assembly can be appropriately driven along the rail even when the rail is deformed, and the damper and the roller assembly can be easily removed through a short space of the extension rail.

According to an aspect of the present invention, there is provided a self-closing device configured to automatically close a door moving along a rail aligned straightly with an extension rail. The sliding door self-closing device includes: a damper configured to move along the rail to automatically close the door and smoothen a closing speed; and a roller assembly pivotably connected to a front end of the damper to move along the rail. The damper has a body configured to automatically close the door and smoothen a closing speed, an insertion block disposed at the front end of the body and provided with a connection ball protruding on its front end, a metal casing provided in outer side surfaces of the body and the insertion block to fix the body and the insertion block, and a roller provided at the rear end of the metal casing. The roller assembly has a body, two pairs of rollers provided in front and rear sides of the body, a connection block provided with a receptacle cavity integratedly formed in the rear end of the body to receive the connection ball and an insertion hole into which a front part of the insertion block is inserted so that the rear end adjoins with the stoppers to prevent the roller assembly from pivoting upward about the damper, and a fixing pin provided to extend horizontally across the connection block to prevent the connection ball inserted into the receptacle cavity from being removed from the upper side of the receptacle cavity.

Here, a lower part of the receptacle cavity of the connection block has a curved tapered shape whose diameter is gradually reduced downward, so that the connection ball is prevented from being removed from a lower side of the receptacle cavity.

Preferably, a lid is provided in an upper side of the inside of the receptacle cavity.

Preferably, an insertion tube is provided in an upper side of the front end of the insertion block, and a coil spring is provided inside the inner tube, so that a tip of the coil spring abuts on an outer side surface of the lid when the damper and the roller assembly are aligned straightly.

Preferably, a predetermined gap is formed between an outer side surface of the insertion block of the damper and an inner wall surface of the connection block provided with the insertion hole, and the roller assembly is rotated with respect to the connection ball by a predetermined angle within a range of the gap.

Preferably, the sliding door self-closing device further includes a roller bracket fixed to an upper end of the door. The roller bracket is fastened to a locking nut provided inside the body of the roller assembly in a thread coupling manner.

DETAILED DESCRIPTION

A sliding door self-closing device according to preferred embodiments of the present invention will now be described with reference to the accompanying drawings.

Figure 1:
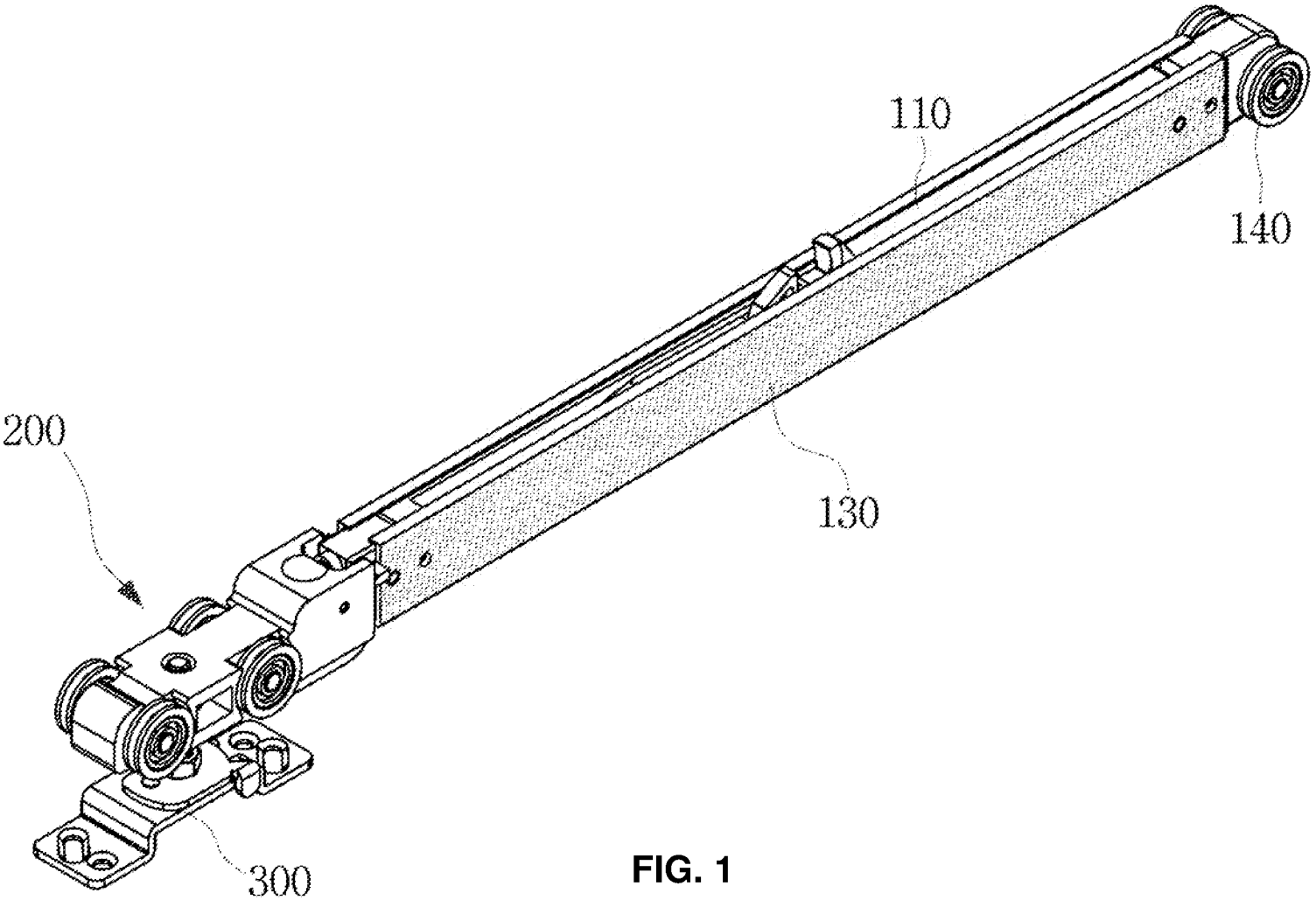
FIGS. 1 to 3 are perspective views illustrating a sliding door self-closing device according to an embodiment of the invention.
Figure 2:
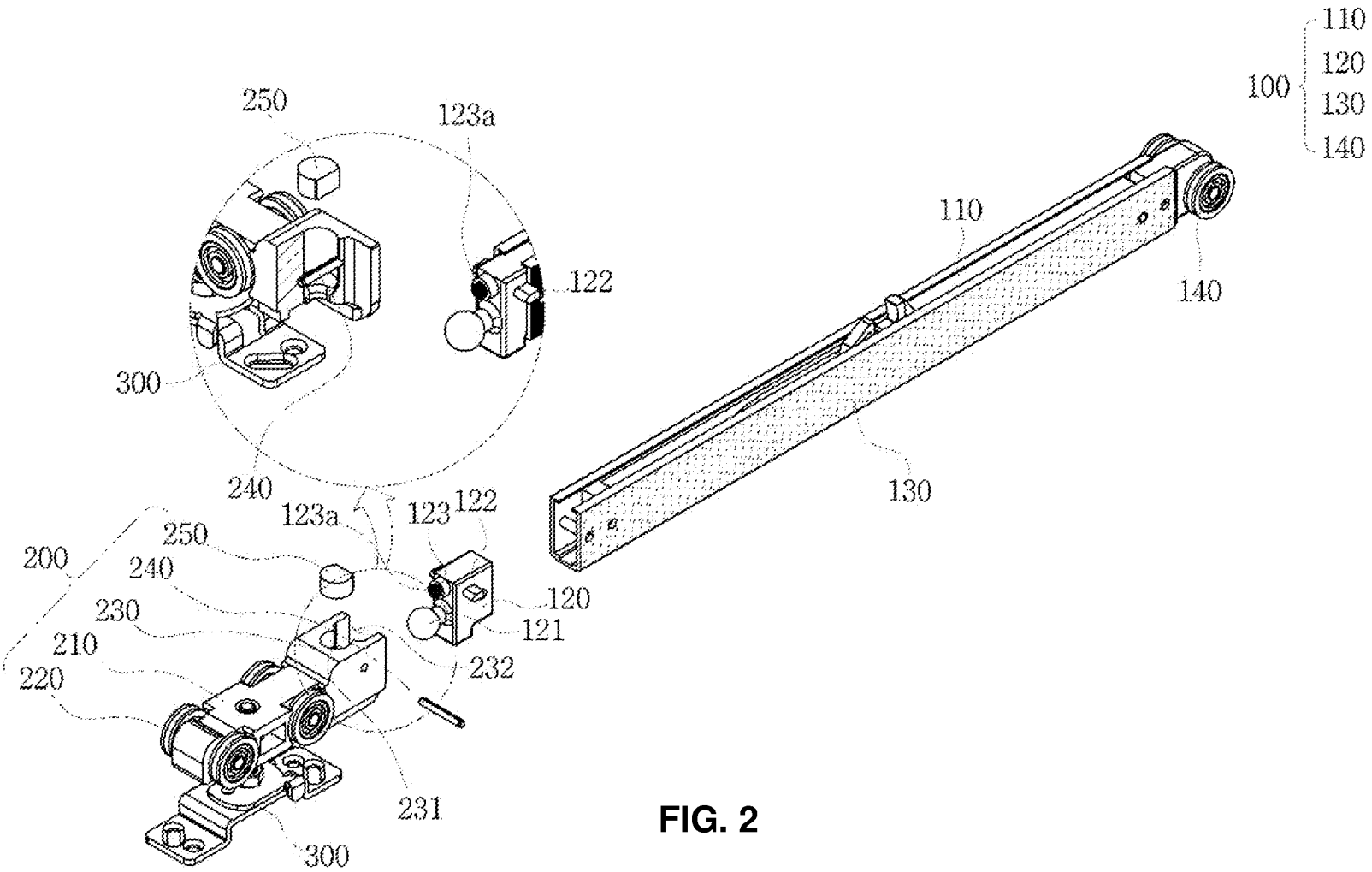
Figure 3:
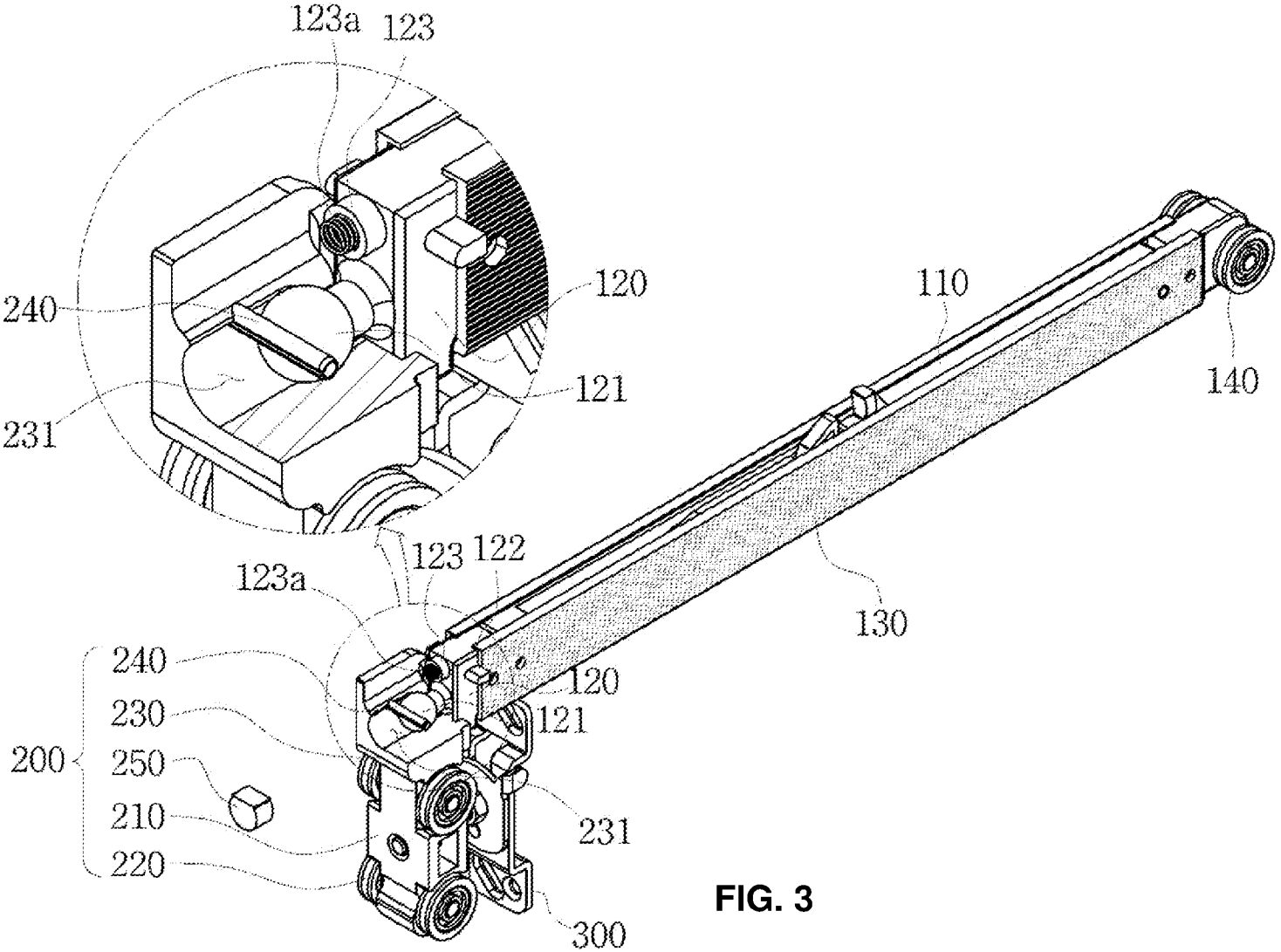
Figure 4:
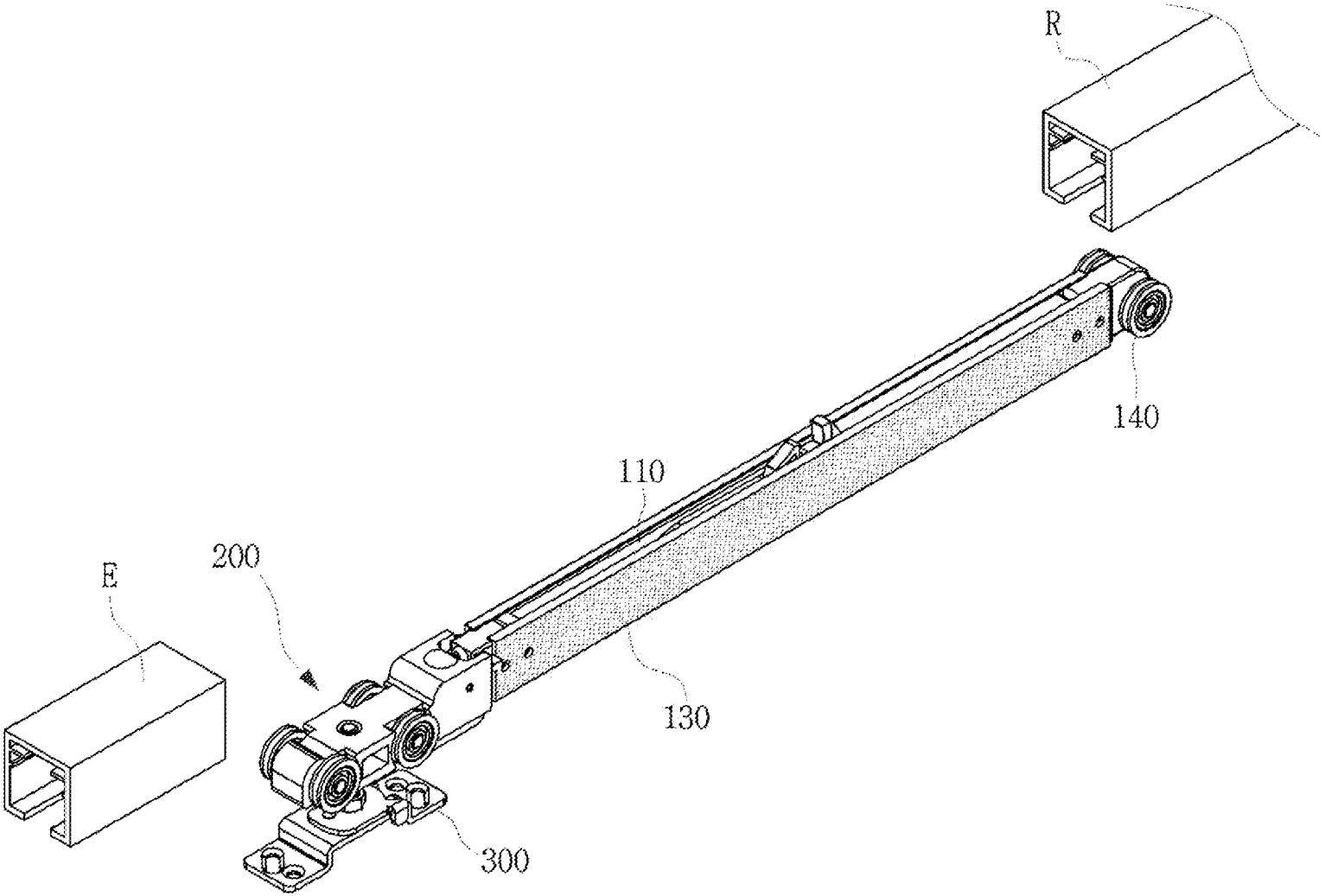
FIG. 4 is a diagram illustrating a sliding door self-closing device, a rail, and an extension rail according to an embodiment of the invention.
Figure 5A:
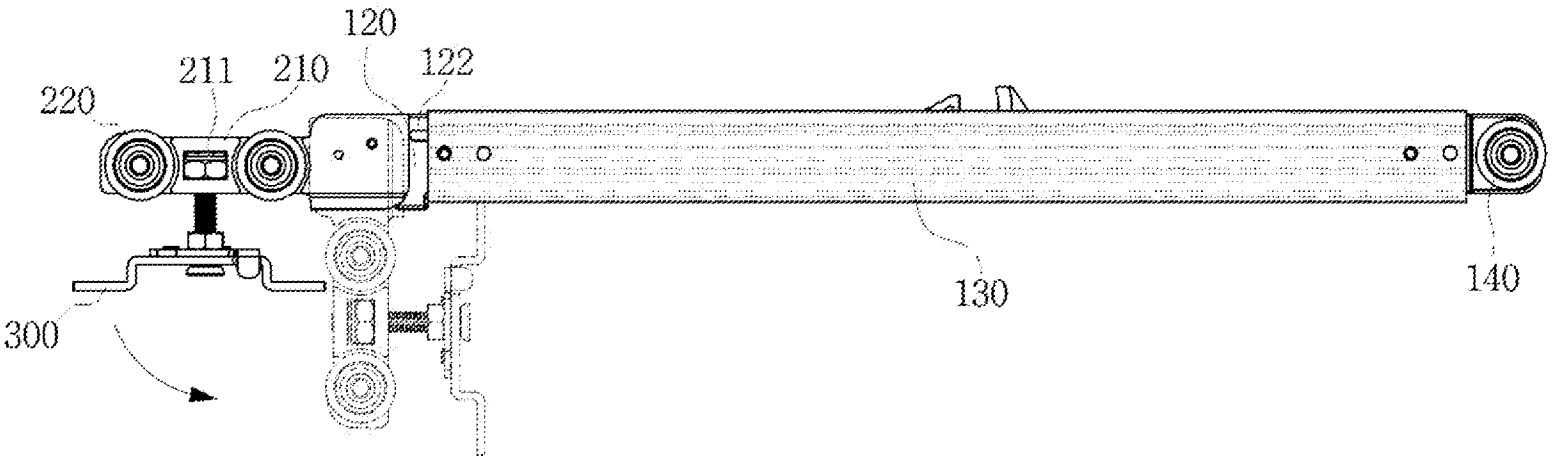
FIGS. 5A and 5B are diagrams illustrating pivoting and rotating operations of a roller assembly of the sliding door self-closing device according to an embodiment of the invention.
Figure 5B:
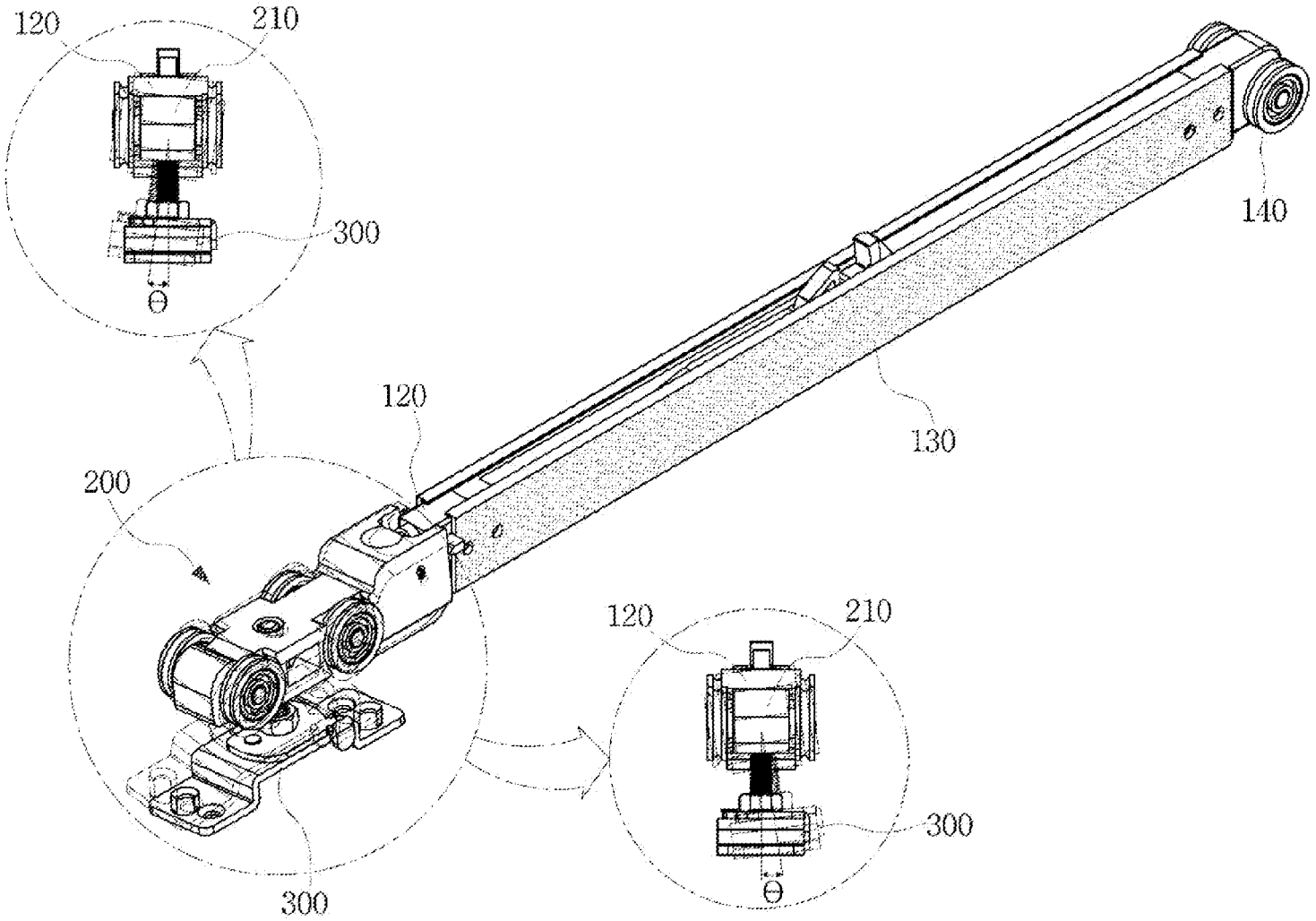

FIGS. 1 to 3 are perspective views illustrating a sliding door self-closing device according to an embodiment of the invention. FIG. 4 is a diagram illustrating a sliding door self-closing device, a rail, and an extension rail according to an embodiment of the invention. FIGS. 5A and 5B are diagrams illustrating pivoting and rotating operations of a roller assembly of the sliding door self-closing device according to an embodiment of the invention.

Figure 6:
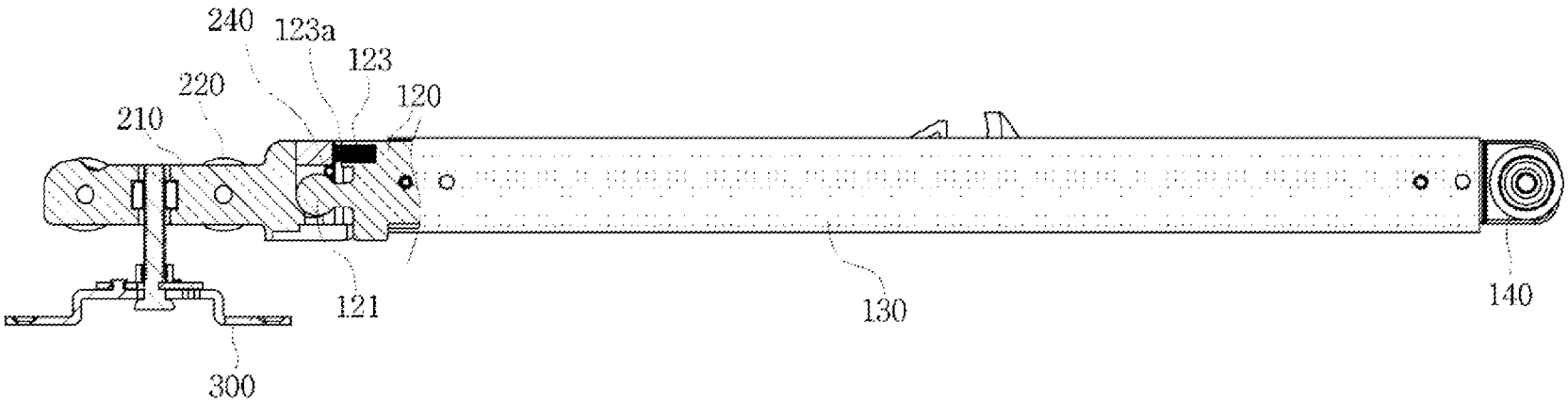
FIG. 6 is a partially cross-sectional view illustrating the sliding door self-closing device according to an embodiment of the invention.
Figure 7A:
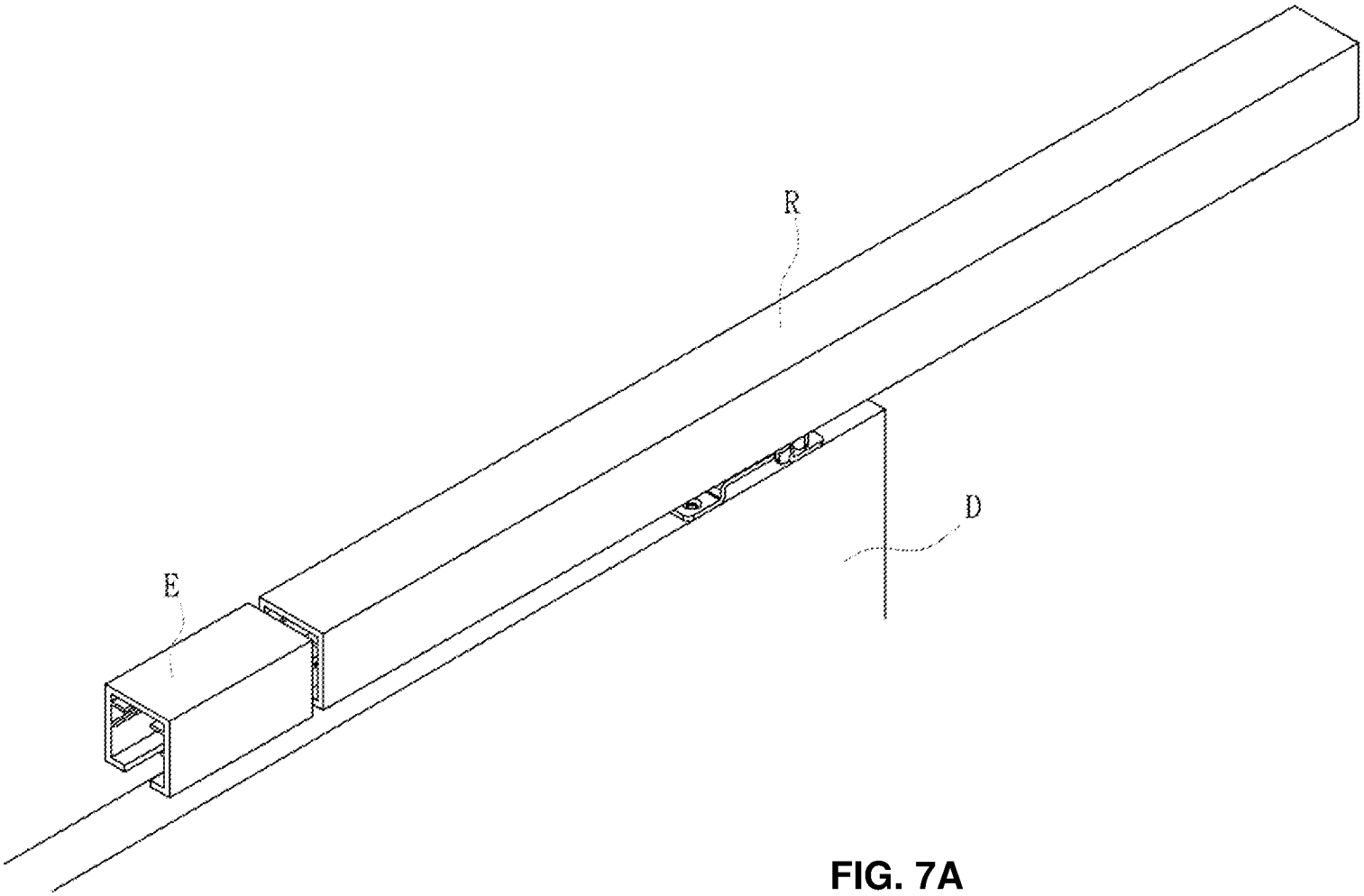
FIGS. 7A and 7B are diagrams illustrating a state of the sliding door self-closing device installed in the rail according to an embodiment of the invention.
Figure 7B:
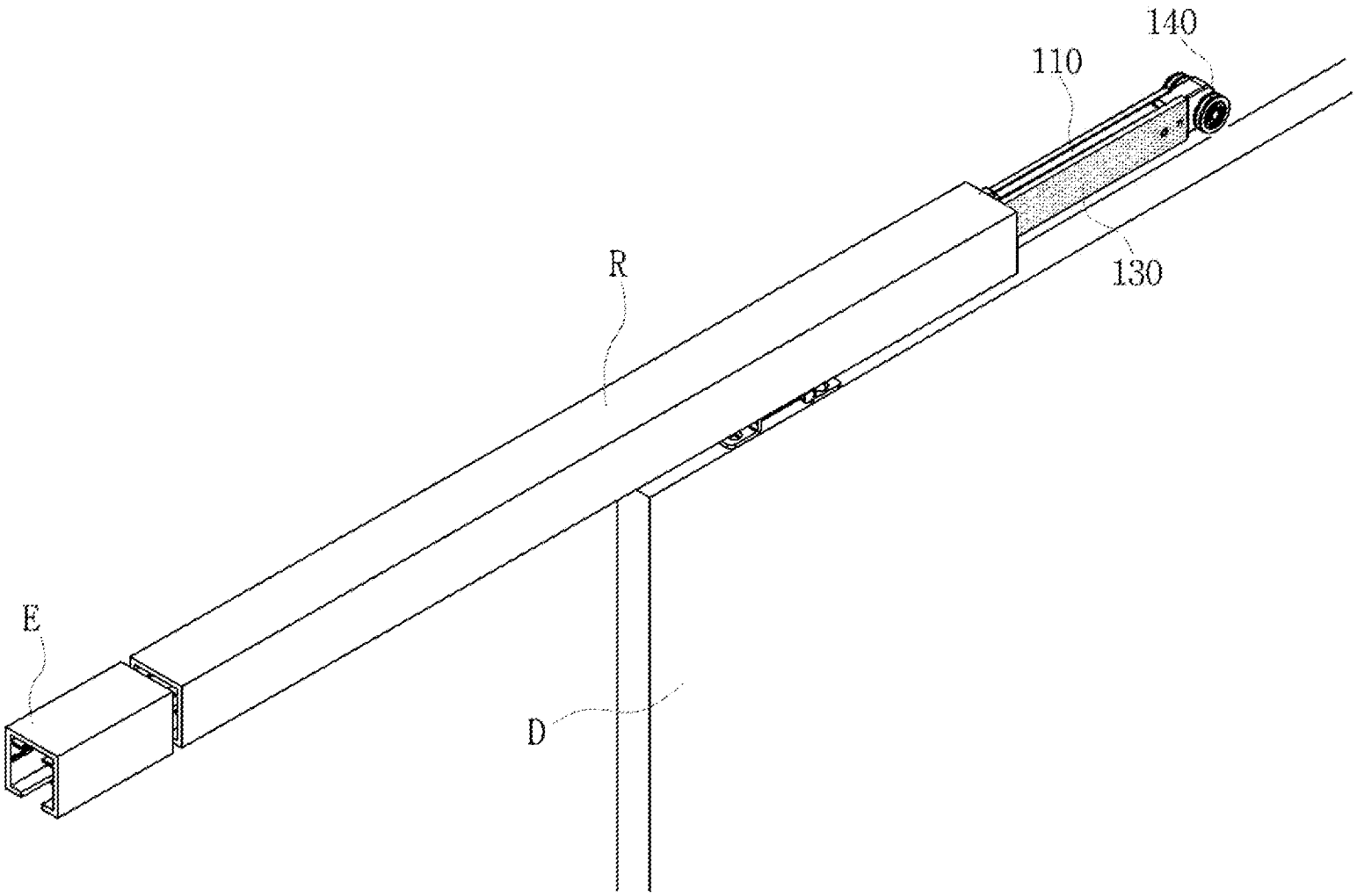
Figure 8:
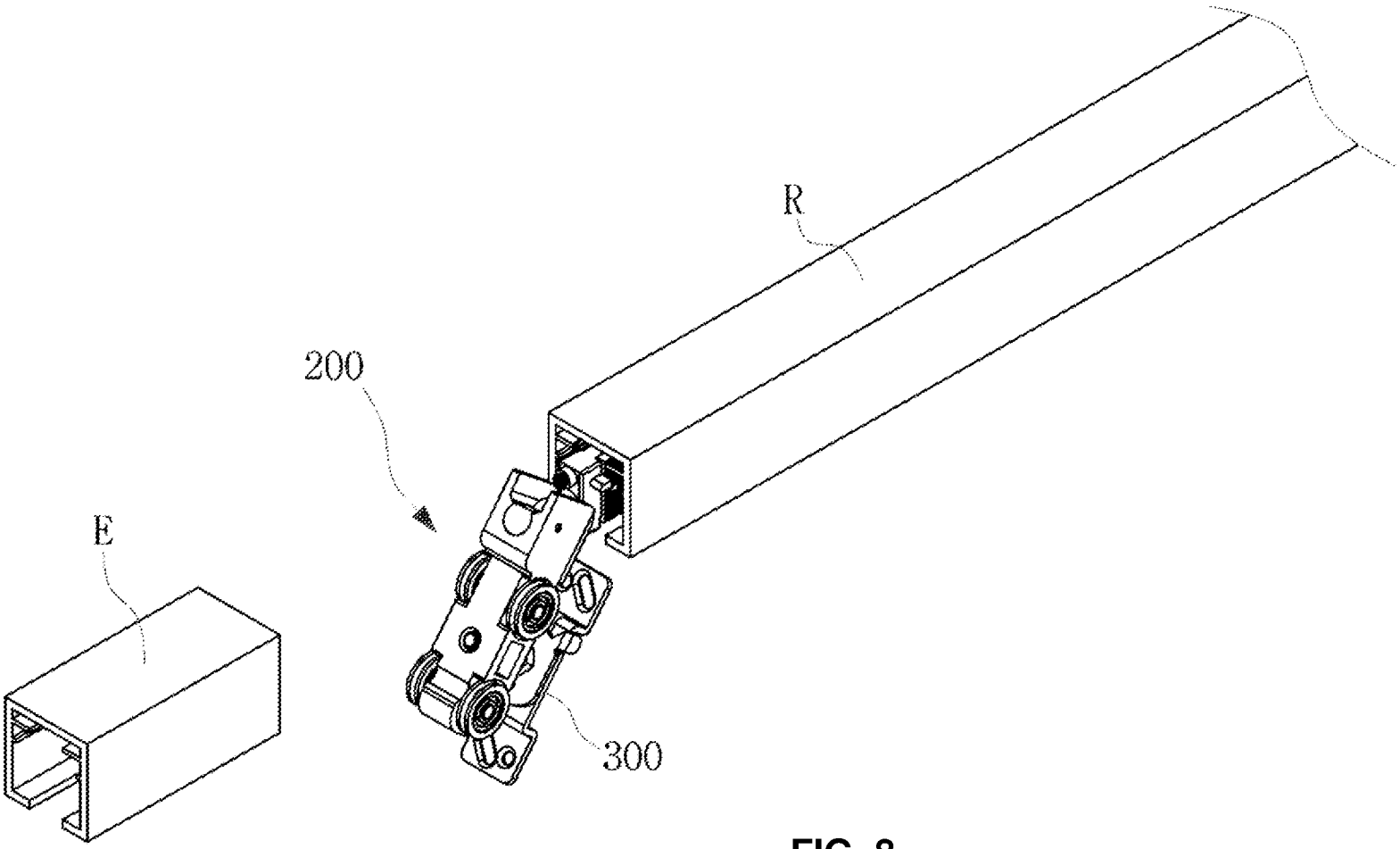
FIG. 8 is a perspective view illustrating a state of the sliding door self-closing device removed from the rail according to an embodiment of the invention.

FIG. 6 is a partially cross-sectional view illustrating the sliding door self-closing device according to an embodiment of the invention. FIGS. 7A and 7B are diagrams illustrating a state of the sliding door self-closing device installed in the rail according to an embodiment of the invention. FIG. 8 is a perspective view illustrating a state of the sliding door self-closing device removed from the rail according to an embodiment of the invention.

The sliding door self-closing device according to the present invention is a device for automatically closing a door D sliding along a rail R straightly aligned with an extension rail E.

The sliding door self-closing device includes a damper 100, a roller assembly 200 rotatably connected to a front end of the damper 100, and a roller bracket 300 connected to the roller assembly 200.

When the door D is closed, the damper 100 moves along the rail R and is operated to automatically and perfectly close the door D at the door closing end of the rail D. In addition, the damper 100 is operated to smoothen a closing speed of the door D.

The damper 100 has a body 110, an insertion block 120 placed at the front end of the body 110, a metal casing 130 provided in an outer side surface of the insertion block 120, and a roller 140 provided at the rear end of the metal casing 130.

The body 110 is internally provided with a cylinder or spring (not shown), a switch, or the like to smoothen the closing speed while perfectly closing the door D. These components such as the cylinder or spring are well known in the art, and will not be described in detail herein for simplicity purposes.

The insertion block 120 is fabricated in a hexahedral shape and is disposed at the front end of the body 110. In addition, the insertion block 120 has a protruding connection ball 121, a pair of stoppers 12 protruding on both side surfaces, and a protruding insertion tube 123 disposed above the connection ball 121.

The connection ball 121 protrudes in the center of the front end of the insertion block 120 in an integrated manner and has a ball-shaped tip. The connection ball 121 having such a ball shape is inserted into a receptacle cavity 231 of the roller assembly 200 as described below.

The stoppers 122 protrude from the upper parts on both side surfaces of the insertion block 120. The stoppers 12 adjoin with the rear end of a connection block 230 of the roller assembly 200 as described below, so that the roller assembly 200 is prevented from pivoting upward with respect to the damper 100. When the roller assembly 200 and the damper 100 are aligned straightly, the stoppers 122 protrudes from gaps between the connection block 230 of the roller assembly 200 and the metal casing 130 as described below while their front ends adjoin with the connection block 230, and their rear ends adjoin with the metal casing 130.

The insertion tube 123 protrudes from the upper part on the front end of the insertion block 120. The insertion tube 123 is internally provided with a coil spring 123*a*. The roller assembly 200 is pivotable vertically about the front end of the damper 100. When the roller assembly 200 and the damper 100 are aligned straightly during the pivoting, the rear end of the coil spring 123*a* abuts on a lid 250 described below.

The metal casing 130 is provided along the outer side surfaces of the body 110 and the insertion block 120 to fix the body 110 and the insertion block 120. The metal casing 130 is formed of metal such as aluminum to reinforce the body 110. If the self-closing device is used for a long time, the body 110 formed of a plastic material may be stressed for a long time. In some cases, the body 110 may be fractured on its side surface due to such a stress. In order to reinforce the body 110, the body 110 is fixed to the metal casing 130 on its both side surfaces.

The rollers 140 are provided in both sides of the rear end of the metal casing 130 to allow the body 110 to slide along the rail R.

The roller assembly 200 guides the door D when the door D is opened or closed. The roller assembly 200 is pivotally connected to the front end of the damper 100 and moves along the rail R.

The roller assembly 200 includes a body 210, two pairs of rollers 220 provided in front and rear sides of the body 210, a connection block 230 integrated into the rear end of the body 210, a fixing pin 240 provided horizontally across the connection block 230, and a lid 250 provided inside the body 210.

The body 210 has an internal locking nut 211 provided in its inner center and fastened to the roller bracket 300.

The locking nut 211 prevents the roller assembly 200 from being unfastened from the roller bracket 300. If an automatic fastener is installed and used for a long time for this purpose, a continuous vibration applied thereto may weaken a coupling force between the roller assembly 200 and the roller bracket 300, and they may be finally released. In order to prevent such a failure, the locking nut 211 and the roller bracket 300 are fastened to each other in a thread coupling manner.

At least four rollers 220 are installed in both sides of the front and rear ends of the body 210.

The connection block 230 has a vertically penetrating receptacle cavity 231 and an insertion hole 231 provided in rear of the receptacle cavity 231 to communicate with the receptacle cavity 231.

In the connection block 230 formed in this manner, its rear end comes in contact with front ends of the stoppers 122 of the insertion block 120 when the damper 100 and the roller assembly 200 are aligned straightly. As a result, it is possible to the roller assembly 200 from being pivoted upward with respect to the damper 100. Therefore, while the roller assembly 200 is pivotable downward about the damper 100 up to an angle of, approximately, 90°, its upward pivoting is prevented. In addition, the roller assembly 200 is prevented from horizontally pivoting about the damper 100.

The receptacle cavity 231 is formed to vertically penetrate in the center of the connection block 230. The connection ball 121 of the insertion block 120 is inserted into the inside of the receptacle cavity 231 so that it is revolved inside the receptacle cavity 231 when the roller assembly 200 is pivoted about the damper 100.

Meanwhile, the receptacle cavity 231 has a curved tapered shape whose diameter is gradually reduced downward, so that a diameter of the lower end of the receptacle cavity 231 is smaller than an outer diameter of the connection ball 121. Therefore, the connection ball 121 is prevented from being removed through the lower side of the receptacle cavity 231. In addition, since the lower wall surface of the connection block 230 of the receptacle cavity 231 is cured as described above, it does not hinder the revolution of the connection ball 121.

The insertion hole 232 is formed in the rear end of the connection block 230 and communicates with the receptacle cavity 231. The front part of the insertion block 120 is inserted into the inside of the insertion hole 232. When the insertion block 120 is inserted into the insertion hole 232, the outer side surface of the insertion block 120 and the inner wall surface of the connection block 230 provided with the insertion hole 232 do not abut on each other, but are separated by a predetermined gap. Therefore, the roller assembly 200 is rotated by a certain angle θ with respect to the connection ball 121 within a range of the gap. That is, when the roller assembly 200 is rotated with respect to the connection ball 121 provided in the center of the front end of the damper 100, the inner wall surface of the connection block 230 provided with the insertion hole 232 comes in contact with the outer side surface of the front part of the insertion block 120, and the roller assembly 200 is not rotated any more. Therefore, the rotation of the roller assembly 200 is restricted. Preferably, a rotation angle of the roller assembly 200 with respect to the connection ball 121 is set to, approximately, ±5° with respect to the connection ball 121. In general, even the rail R employed in typical furniture is distorted, its distortion angle is not significant. It is considered that the roller assembly 200 can be appropriately operated inside the rail R if the distortion angle is within ±5°.

The fixing pin 40 is provided to prevent the connection ball 121 of the insertion block 120 inserted into the receptacle cavity 231 from being removed from the upper side of the receptacle cavity 231. As described above, since the diameter of the lower end of the receptacle cavity 231 is smaller than the diameter of the connection ball 121, the connection ball 121 is prevented from being removed to the lower side of the receptacle cavity 231. In addition, since the fixing pin 240 provided across the receptacle cavity 231 restricts the connection ball 121, the connection ball 121 is also prevented from being removed to the upper side of the receptacle cavity 23.

The lid 250 is installed in the upper side of the receptacle cavity 121 to prevent a foreign object from intruding into the inside of the receptacle cavity 231.

As described above, the coil spring **123*a* is provided in the insertion tube 123 of the insertion block 120. When the damper 100 and the roller assembly 200 are aligned straightly, a tip of the coil spring 123*a* abuts on the outer surface of the lid 250**.

The roller bracket 300 is connected to the body 10 of the roller assembly 200 and is fixed to the upper end of the door D. The roller bracket 300 is fastened to the locking nut 211 provided in the inside of the body 210 of the roller assembly 200 in a thread coupling manner.

In other words, the roller bracket 300 is extruded from the rail R and is connected to the body 210 as well as the door D. Therefore, the rollers 220 of the roller assembly 200 is placed inside the rail R to support the door D and allow movement of the door D.

The sliding door self-closing device according to the present invention will now be described in more details. The extension rail E is placed in a door opening start position in the door opening direction such that the rail R is straightly aligned with the extension rail E. The self-closing device obtained by assembling the damper 100, the roller assembly 200, and the roller bracket 300 is installed in an upper end of the door D, and the rail R is then installed.

If the rail R is deformed by an external force in this state, it is difficult to appropriately drive the damper 100 and the roller assembly 200 sliding along the rail R only by a rectilinear motion.

In this case, if the roller assembly 200 is vertically pivoted by a certain angle about the damper 100, or the roller assembly 200 is rotated with respect to the connection ball 121 by a certain angle as much as the deformation of the rail R, the door D can be appropriately driven even along the deformed rail D.

Meanwhile, in order to check the damper 100 or the roller assembly 200 installed in the rail R for maintenance or inspection purposes, it is necessary to remove the extension rail E and then remove the damper 100 or the roller assembly 200 from the rail R.

However, it is difficult to remove the damper 100 and the roller assembly 200 from the rail R because the extension rail E typically has a length of 10 cm, and a total length of the damper 100 and the roller assembly 200 is typically much longer than that of the extension rail E. For this reason, according to an embodiment of the present invention, the damper 100 and the roller assembly 200 are rotatably connected. Since the damper 100 and the roller assembly 200 are not fixed to each other, the coil spring **123*a* is provided to evenly transmit a force to the damper 100 and the roller assembly 200. In this configuration according to an embodiment of the present invention, it is possible to easily remove the damper 100 and the roller assembly 200 from the rail R by rotating the damper 100 and the roller assembly 200** in a space formed by removing the extension rail E.

In the sliding door self-closing device according to the present invention, the roller assembly is vertically pivoted about the damper, and the roller assembly is rotated with respect to the connection ball of the damper within a predetermined small angle range. Therefore, it is possible to ensure appropriate driving along the rail even when the rail is deformed. In addition, it is possible to easily remove the damper and the roller assembly through a short space of the extension rail.

An elastic force of the coil spring is evenly transmitted to the damper and the roller assembly when the damper and the roller assembly are straightly aligned. Therefore, the rollers of the damper and the rollers of the roller assembly abut on the rail. Accordingly, it is possible to facilitate sliding of the door.

What is claimed is:

1. A self-closing device configured to automatically close a door moving along a rail aligned straightly with an extension rail, comprising:

a damper configured to move along the rail to automatically close the door and smoothen a closing speed; and a roller assembly pivotably connected to a front end of the damper to move along the rail, wherein the damper comprises:

a damper body configured to automatically close the door, an insertion block disposed at the front end of the damper body and provided with a connection ball protruding on its front end, a metal casing provided on outer side surfaces of the damper body and the insertion block in a manner that the metal casino fixes the damper body and the insertion block, and a roller provided at a rear end of the metal casing opposite of the insertion block, wherein the roller assembly comprises:

a roller body, two pairs of rollers provided in front and rear sides of the roller body, a connection block provided with a receptacle cavity integratedly formed in the rear end of the roller body and receives the connection ball and an insertion hole into which a front part of the insertion block is inserted, and a fixing pin provided in the connection block, wherein an outer side surface of the insertion block of the damper and an inner wall surface of the connection block provided with the insertion hole are separated from each other by a predetermined gap, wherein the roller assembly is rotated with respect to the connection ball by a predetermined angle within a range of the gap, wherein stoppers protrude from both lateral side surfaces of the insertion block, and a rear end of the connection block adjoins the stoppers, in a manner that the roller assembly is prevented from pivoting upward about the damper, wherein the fixing pin extends horizontally across the connection block to prevent the connection ball inserted into the receptacle cavity from being removed from an upper side of the receptacle cavity, and wherein a lower part of the receptacle cavity of the connection block has a curved tapered shape whose diameter is gradually narrowed, so that the connection ball is prevented from being removed from a lower side of the receptacle cavity.

2. The sliding door self-closing device according to claim 1, further comprising a lid provided in the upper side of the inside of the receptacle cavity.

3. The sliding door self-closing device according to claim 2, wherein an insertion tube is provided in an upper side of the front end of the insertion block, and a coil spring is provided inside the inner tube, so that a tip of the coil spring abuts on an outer side surface of the lid when the damper and the roller assembly are aligned straightly.

4. The sliding door self-closing device according to claim 1, further comprising a roller bracket fixed to an upper end of the door, wherein the roller bracket is fastened to a locking nut provided inside the body of the roller assembly in a thread coupling manner.

* * * * *